US009635938B2

(12) United States Patent
Kim

(10) Patent No.: US 9,635,938 B2
(45) Date of Patent: May 2, 2017

(54) RAIL ASSEMBLY EQUIPPED WITH AUTO CLOSING UNIT AND REFRIGERATOR HAVING THE SAME

(71) Applicant: LG ELECTRONICS INC., Seoul (KR)

(72) Inventor: Lyunsu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/837,680

(22) Filed: Aug. 27, 2015

(65) Prior Publication Data

US 2016/0138851 A1 May 19, 2016

(30) Foreign Application Priority Data

Nov. 18, 2014 (KR) ..... 10-2014-0160860

(51) Int. Cl.
*F25D 23/02* (2006.01)
*A47B 88/04* (2006.01)
*F25D 25/02* (2006.01)

(52) U.S. Cl.
CPC ..... *A47B 88/047* (2013.01); *F25D 23/02* (2013.01); *F25D 25/025* (2013.01)

(58) Field of Classification Search
CPC . A47B 88/047; A47B 88/0481; F25D 23/028; F25D 2323/02
See application file for complete search history.

(56) References Cited

U.S. PATENT DOCUMENTS

| | | | | |
|---|---|---|---|---|
| 7,784,890 | B1 | 8/2010 | Chen | |
| 8,308,251 | B2 | 11/2012 | Liang et al. | |
| 2011/0050065 | A1* | 3/2011 | Lee | E05B 17/0033 312/402 |
| 2011/0080080 | A1* | 4/2011 | Zimmer | A47B 88/047 312/319.1 |
| 2014/0072248 | A1* | 3/2014 | Chen | A47B 88/0481 384/20 |
| 2014/0300262 | A1* | 10/2014 | Flogaus | A47B 88/0481 312/319.1 |

FOREIGN PATENT DOCUMENTS

| | | | |
|---|---|---|---|
| KR | 20-0377907 | Y1 | 3/2005 |
| KR | 10-2007-0075671 | A | 7/2007 |
| KR | 10-2011-0016806 | A | 2/2011 |

* cited by examiner

*Primary Examiner* — Daniel Rohrhoff
(74) *Attorney, Agent, or Firm* — KED & Associates, LLP

(57) ABSTRACT

A refrigerator a first rail assembly provided at a first side surface of the storage compartment, and a second rail assembly provided at a second side surface of the storage compartment. At least one of the first or second rail assembly includes a fixed rail, a movable rail and an auto closure module. The fixed rail is mounted to first or second side surface of a storage compartment. The movable rail slides along a lateral direction of the fixed rail and is coupled to a door frame. An auto closure module is provided at the rear of the fixed rail, and includes first and second elastic springs having different lengths. The first elastic spring moves with the movable rail such that a restorative force is not exerted for a prescribed distance as the door is pulled, and the second elastic spring has a first end, which moves with the movable rail, and a second end, which is fixed, and such that the second elastic spring exerts a restorative force as the door is pulled.

9 Claims, 6 Drawing Sheets

RAIL ASSEMBLY EQUIPPED WITH AUTO CLOSING UNIT AND REFRIGERATOR HAVING THE SAME

CROSS-REFERENCE TO RELATED APPLICATION

This application claims priority under 35 U.S.C. §119 to Korean Patent Application No. 10-2014-0160860 filed on Nov. 18, 2014, whose entire disclosure is herein incorporated by reference.

BACKGROUND

1. Field

The present disclosure relates to a rail assembly equipped with an auto closing unit or module and a refrigerator having the same.

2. Background

In a drawer typed door or a drawer structure, an auto closing unit or assembly for allowing the door or the drawer to be completely closed may be mounted. In the auto closing unit that is disclosed in the related art, a pair of springs are mounted on the left and right sides thereof, as disclosed in U.S. Pat. No. 7,784,890, so that the door or the drawer can be automatically closed by elastic restoring force of the springs.

In the case of the refrigerator, the drawer typed door opens or closes a storage compartment of the refrigerator while slidably moving in a lateral direction. In this instance, the door is configured to slidably move in an upright state, and the rear edges of the door are brought into close contact with the front edges of the storage compartment. Due to such configuration, a force for overcoming a weight the door, storage box and food is required in order to open the drawer type door.

A magnet is also enclosed inside a gasket mounted on a rear surface of the door, and therefore a force capable of overcoming a magnetic force acting between the rear surface of the door and a front surface of a main body of the refrigerator is further required to open the drawer. In addition, the internal pressure of the storage compartment closed by the door may be lower than the external pressure, and therefore a force capable of overcoming a difference between the internal pressure and the external pressure may be further required. Moreover, a force capable of overcoming the restoring force of the spring provided in the auto closing unit is further required.

In order to open the drawer type door of the refrigerator, the greatest opening force is required shortly before the gasket is separated from the main body of the refrigerator. When the gasket is separated from the main body of the refrigerator, the magnetic force of the magnet in the gasket disappears, and a negative pressure condition of the storage compartment is released, and therefore the opening force is reduced.

Compared to, for example, a desk drawer, the above described weights, the magnetic force of the gasket, the pressure difference, and auto closing springs of the drawer type door of the refrigerator creates inconvenience or difficulty for consumers such as children, the elderly, or women, to open the refrigerator drawer door. However, there is a need to balance the need to minimize the door opening force and a force required to auto closing the refrigerator drawer door.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
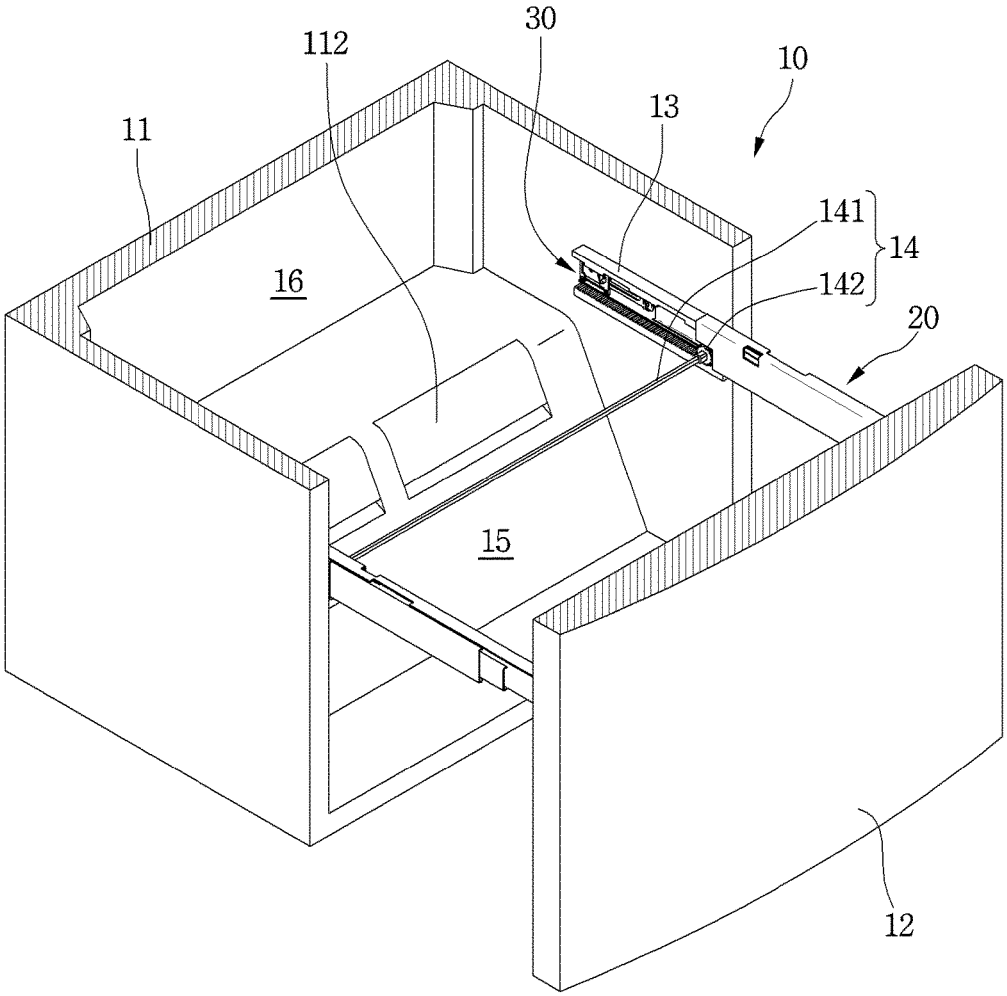
FIG. 1 is a partial perspective view showing an internal configuration of a refrigerator in which an auto closing unit according to an embodiment of the present disclosure is provided.
Figure 2:
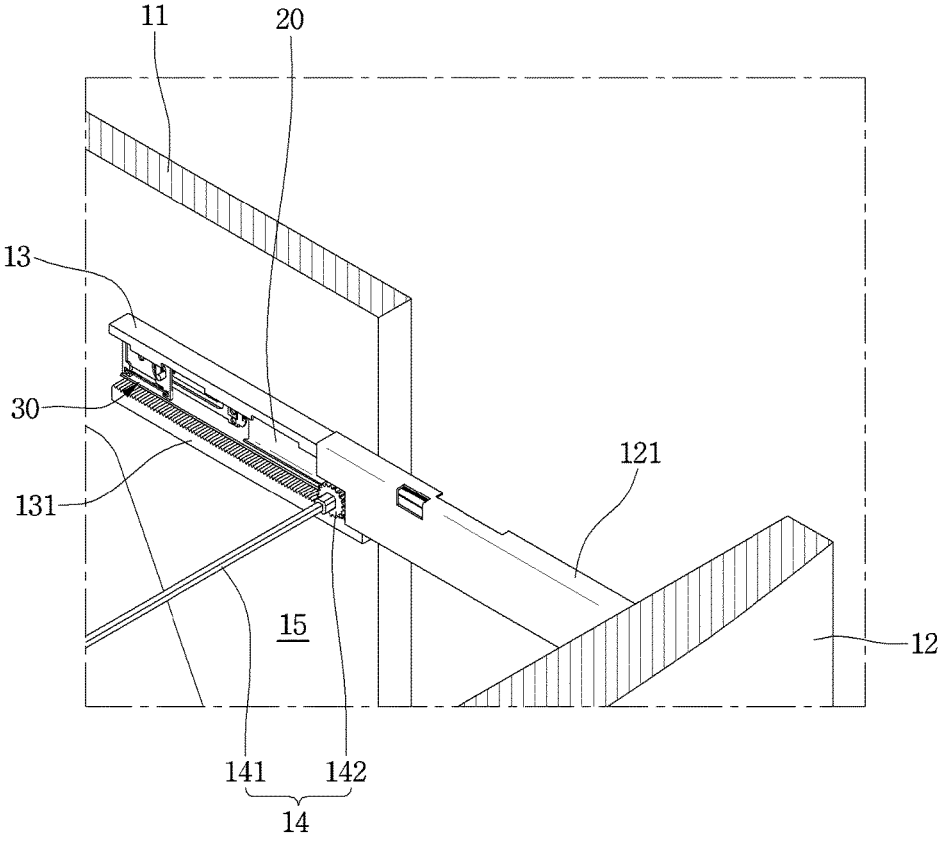
FIG. 2 is an enlarged perspective view showing a rail assembly in which an auto closing unit is provided.

FIG. 1 is a partial perspective view illustrating an internal configuration of a refrigerator in which an auto closing unit (module or assembly) according to an embodiment of the present disclosure is provided, and FIG. 2 is an enlarged perspective view showing a rail assembly in which an auto closing unit is provided. A refrigerator 10 in which an auto closing unit (module or assembly) is provided may include a cabinet 11 having a storage compartment 15; a door 12 that selectively opens and closes the storage compartment 15; a rail assembly 20 that allows the door 12 to slidably move; and an auto closing unit (module or assembly) 30 that is mounted in the rail assembly 20.

The storage compartment 15 may be a refrigerating chamber or a freezing chamber. An evaporation chamber 16 having an evaporator may be provided at a rear of the storage compartment 15. A cold air return duct 112 is provided on a rear side of the storage compartment 15, such that the cold air in the storage compartment 15 can return to the evaporation chamber 16.

The door 12 may open and close the storage compartment 15 while rectilinearly moving in the forward/rearward directions in an upright state by the rail assembly 20. A pair of door frames 121 horizontally extends rearward from rear left and right edges of the door 12. A pair of rail guides 13 is fixedly mounted on left and right walls of the storage compartment 15, and the rail assembly 20 connects the rail guide 13 and the door frame 121.

Rear ends of the pair of door frames 121 are connected to each other by a stabilizing member or stabilizer 14, so that the door 12 may be prevented from shaking in the left and/or right directions while the door 12 moves forward or backward. The stabilizing member 14 may include a shaft 141 that connects the rear ends of pair of the door frames 121, and a pair of pinions 142 (in alternative, rollers) mounted at both ends of the shaft 141. A pair of guide racks 131 (in alternative, guide grooves) on which the pinions 142 are seated may be respectively formed in the rail guides 13. As the pinions 142 move in the forward or rearward direction along the guide rack 131, the door may stably move forward or backward without shaking in the left/right directions.

Figure 3:
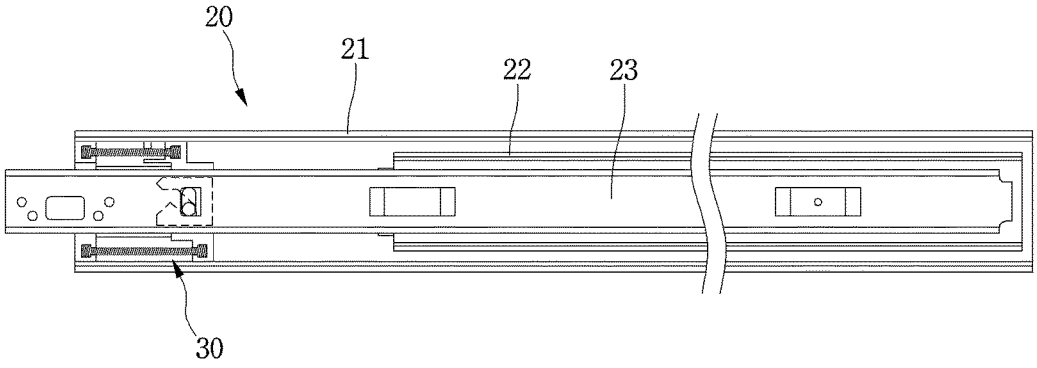
FIG. 3 is a front view showing a rail assembly in which an auto closing unit according to an embodiment of the present disclosure is mounted.

FIG. 3 is a front view illustrating details of a rail assembly 20 an auto closing unit according to an embodiment of the present disclosure. A fixed rail 21 is fixed to the rail guide 13, and an intermediate rail 22 is coupled to a side surface of the fixed rail 21 to be slidably movable. A movable rail 23 is coupled to a side surface of the intermediate rail 22 to be slidably movable.

The movable rail 23 is coupled to the door frame 121, so that it may move together with the door frame 121. The intermediate rail 22 and the movable rail 23 may be withdrawn from a front end portion of the fixed rail 21 in multi-stages. The auto closing unit 30 may be provided on a side surface at the rear end of the fixed rail 21.

Figure 4:
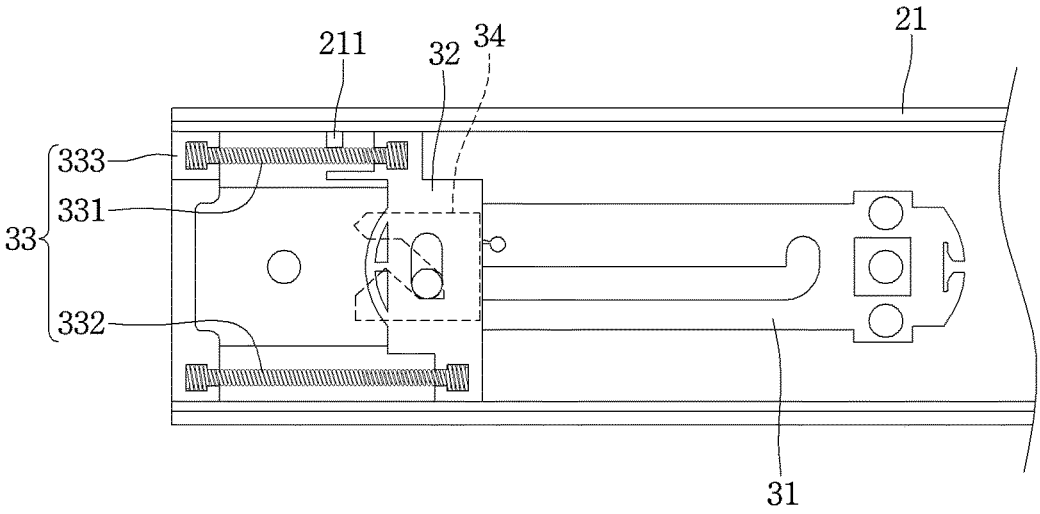
FIG. 4 is a view showing a state in which an auto closing unit is mounted on a rail assembly.

FIG. 4 is a view showing a state in which an auto closing unit 30 is provided in a rail assembly 20. A guide main body 31 (a fixed guide plate) is fixed to the side surface at the rear end of the fixed rail 21. A slider 32 (slide plate) is movable in the forward or rearward direction along the guide main body 31 while being coupled to the guide main body 31. An elastic member 33 has a front end connected to the slider 32, and a hooker 34 (a latch plate) having a groove is fixedly mounted on an arbitrary point at a rear side of the movable rail 23 to allow movement of the slider 34.

The elastic member 33 may include a movable spring 331 and a fixed spring 332. A front end of the movable spring 331 is coupled to the slider 32, and a rear end thereof is maintained as a free end via coupling to a limiter 333 (a mini-slide plate or second slide plate if the slide plate 32 is considered a first slide plate). A front end of the fixed spring 332 is connected to the slider 32, and a rear end thereof is connected to the guide main body 31. The limiter 333 may be mounted at a rear end of the movable spring 331 and is slidable along the fixed rail 21.

A stopper or a tab 211 protrudes from an edge of the fixed rail 21, i.e., the stopper 21 protrudes from a side edge of the fixed rail 21 on which the movable spring 331 is placed. The limiter 333 latches or engages the stopper 211 when the movable spring 331 is moved forward for a prescribed distance so that a rear end of the movable spring 331 becomes fixed.

Base on such arrangement, the hooker 34 draws the slider 32 forward when the movable rail 23 is moved forward (the right side in FIG. 4). The fixed spring 332 is stretched while the slider 32 is moved forward, and the movable spring 331 is stretched after the limiter 333 is latched on the stopper 211 (see FIG. 9).

Next, the rear end portion of the movable spring 331 is maintained as a free end or slides with the limiter 333, until a gasket around the rear edges of the door 12 is separated from a front surface of the cabinet 11. The limiter 333 mounted at the rear end portion of the movable spring 331 is slides along the fixed rail 21 until the limiter 333 latched on the stopper 211 and the gasket is separated from the front surface of the cabinet 11.

Figure 5:
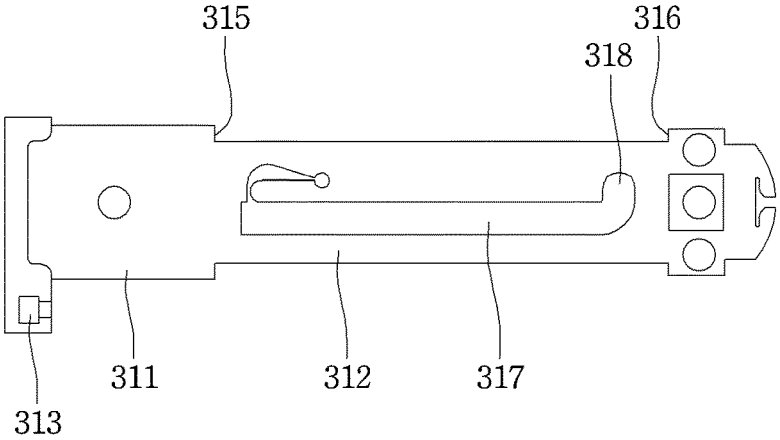
FIG. 5 is a perspective view showing a guide main body constituted in an auto closing unit according to an embodiment of the present disclosure.

FIG. 5 is a perspective view showing a guide main body 31 constituted in an auto closing unit according to an embodiment of the present disclosure.

A first portion or plate 311 includes a spring latched groove 313 at a rear end, and a second portion or plate 312 extends forward from the first portion 311. A slide hole 317 (a horizontal slot) having a predetermined length is provided in the second portion 312, and a latch hole 318 (vertical slot) roundly bending upwards is formed in a front end of the slide hole 317. A vertical height of the first portion 311 is greater than a vertical height of the second portion 312, such that a latched jaw 315 (a step serving as a jam) may be formed at a beginning point of the second portion 312 (at the interface of the first and second portions). The slider 32 is latched or abuts on the latched jaw 315 so that the slider 32 may be prevented from moving further in the rearward direction. A latched jaw 316 is formed at the front side of the second portion 312, so that the slider 32 may be prevented from moving further in the forward direction.

Figure 6:
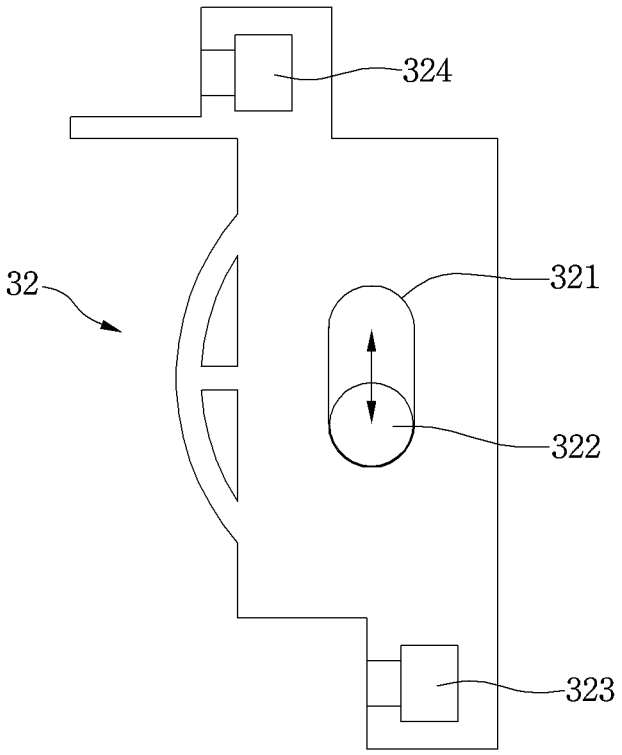
FIG. 6 is a perspective view showing a slider constituted in an auto closing unit according to an embodiment of the present disclosure.

FIG. 6 is a perspective view showing a slider 32 constituted in an auto closing unit according to an embodiment of the present disclosure. The slider 32 is movable in the forward or rearward direction along the second portion 312.

An oval shaped receiving hole 321 extends in a vertical direction of the slider 32 and is formed at around the center of the slider 32. A latching projection 322 (pin shaft) is inserted into the receiving hole 321. The latching projection 322 protrudes from a front surface of the slider 32, passes through a rear surface of the slider 32, and is inserted into the slide hole 317 formed in the guide main body 31. The latching projection 322 is further movable in the longitudinal direction of the projection receiving hole 321.

A first spring latchable groove 324 is formed in a side surface of an upper end portion of the slider 32, and a second spring latchable groove 323 is formed in a side surface of a lower end portion thereof. The front end portion of the movable spring 331 is connected to the first spring latchable groove 324, and the front end portion of the second spring 332 is connected to the second spring latchable groove 323. The first spring latchable groove 324 is arranged behind the second spring latchable groove 323 due to the movable spring 331 having a shorter length than the fixed spring 332.

Figure 7:
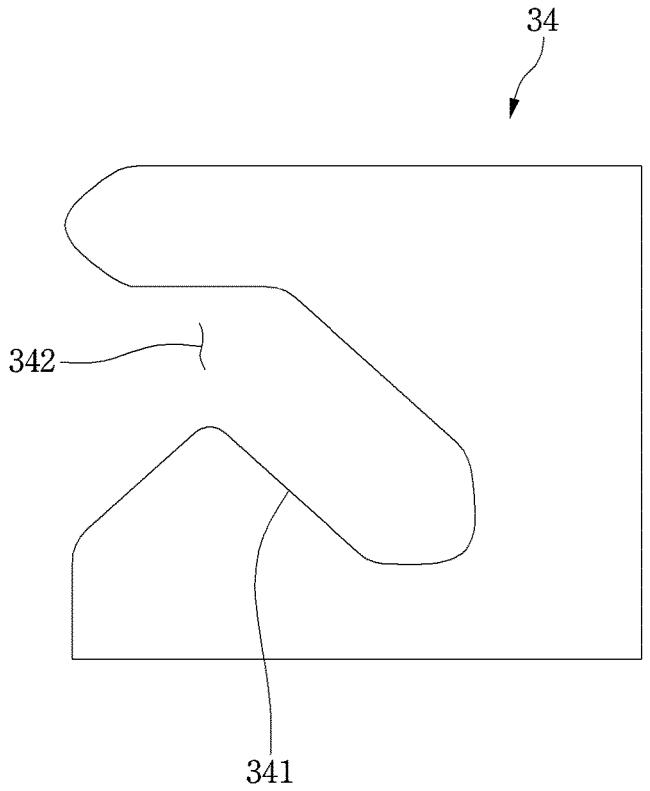
FIG. 7 is a front view showing a hooker constituted in an auto closing unit according to an embodiment of the present disclosure.

FIG. 7 is a front view showing a hooker 34 constituted in an auto closing unit according to an embodiment of the present disclosure. The hooker 34 is mounted on a side surface at a rear end portion of the moving rail 23. An inclined groove 341 into which the latching projection 322 is selectively latched is formed in the hooker 34. The inclined groove 341 is bent at a predetermined angle while being recessed from the rear end portion of the hooker 34 toward the front side, so that the inclined groove 341 extends downward to be inclined at the predetermined angle. An opening 342 formed in the rear end portion of the hooker 34 may allow the latching projection 322 to be inserted into the inclined groove 341. The inclined groove 341 serves to guide the latching projection 322 to be moved from the slide hole 317 to the latched hole 318 or from the latched hole 318 to the slide hole 317.

Figure 8:
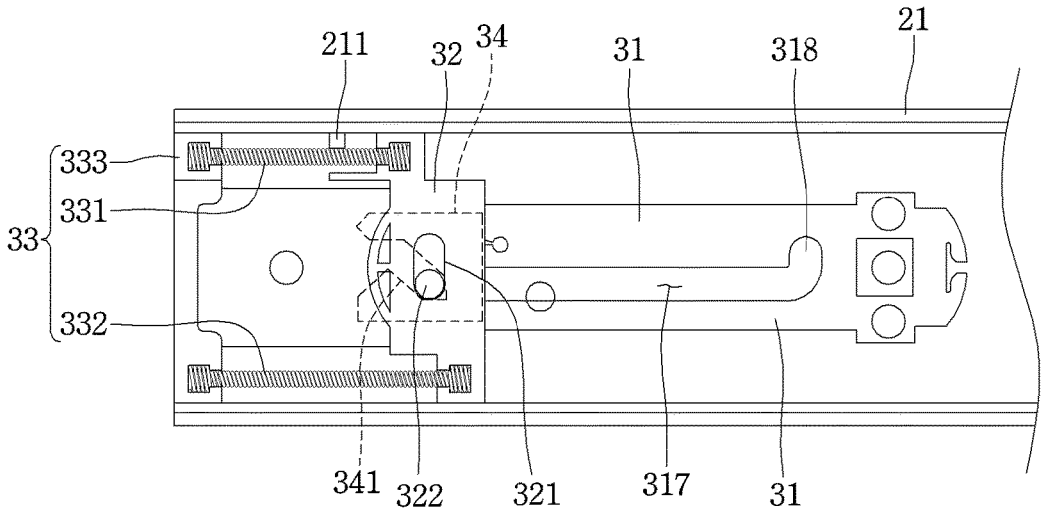
FIGS. 8 to 10 are views sequentially showing an operating state of an auto closing unit when a door is pulled out.
Figure 9:
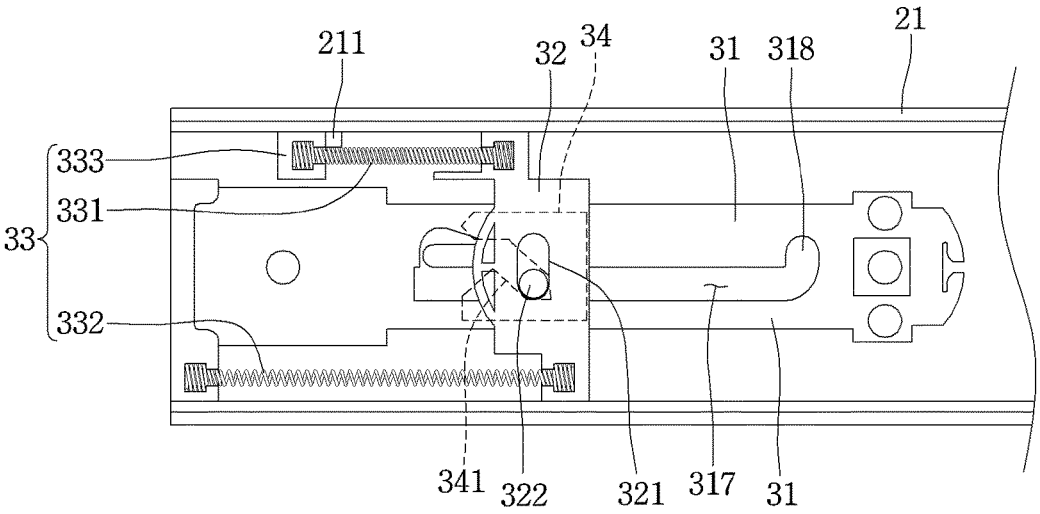
Figure 10:
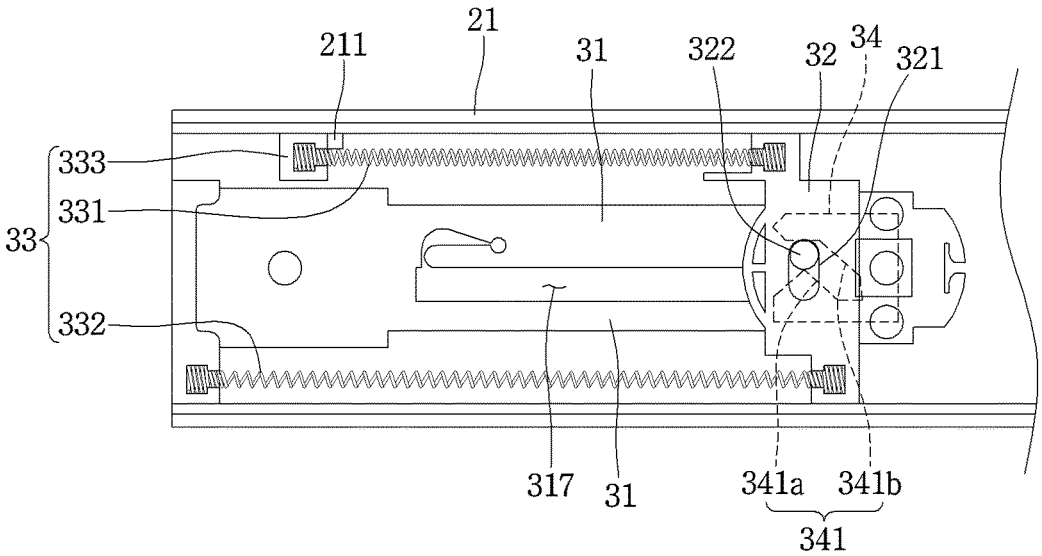

FIGS. 8 to 10 sequentially illustrate an operating state or movement of an auto closing unit when a door is withdrawn. Referring to FIG. 8 illustrating a closed state of the door 12, a rear end of the moving rail 23 is provided at a rear end of the storage compartment 15 (see FIG. 3). The hooker 34 attached to the moving rail 23 is movable together with the slider 32 due to the latching projection 322 inserted into the opening 321 and groove 341. The movable spring 331 and the fixed spring 322 are kept in a stable or steady state, that is, an initial state in which the springs are not stretched.

As the door 12 is pulled, the fixed spring 332 starts to stretch. Because the rear end portion of the movable spring 331 is not fixed, the movable spring 331 moves forward without being stretched with the slider 32. At the moment of pulling the door 12, the gasket which is kept in close contact with the rear surface of the door 12 is uncompressed to its original state, and the door 12 is moved forward until the gasket starts separating from the cabinet 11, but the storage compartment 15 is not opened until the gasket is completely separated from the rear surface of the door 12. The initial pulling of the door to the initial uncompressing of the gasket requires the greatest amount of force in order to open the door 12.

At a stage when the greatest door opening force is needed, the restoring force is not stored in the movable spring 331 due to unfixed end, and therefore, the movable spring 331 does not act as resistance. Thus, a user may open the door with relatively less force compared to when opening the door of the background refrigerator including other types of auto closing units. A force counteracting a magnitude corresponding to the restoring force of the movable spring 331 is not required.

When the door 12 is further moved forward, the gasket is separated from the front surface of the cabinet 11. As the door 12 is slidably moved forward, the limiter 333, connected to the rear end portion of the movable spring 331, is latched on the stopper 221 that protrudes from the fixed rail 21. From the moment that the limiter 333 is latched on the stopper 211, the moving spring 331 starts to be stretched to exert a restoring force on the door 12 with the fixed spring 332.

The length of the moving spring 331 is shorter than the length of the fixed spring 332, and a point of time when the moving spring 331 starts to be stretched is different from a point of time when the fixed spring 332 starts to be stretched. Thus, a magnitude of an elastic restoring force generated in the moving spring 331 may be different from a magnitude of an elastic restoring force generated in the fixed spring 332. Due to different magnitudes, the movable rail 23 may move eccentrically downward while it moves forward, so that the door 12 may not be withdrawn smoothly. In order to prevent the occurrence of such a problem, an elastic coefficient of the movable spring 331 may be set to be larger than an elastic coefficient of the fixed spring 332. A spring having an elastic coefficient larger than the elastic coefficient of the fixed spring 332 may be used as the movable spring 331.

In a section in which the movable spring 331 is not stretched and in order to minimize a eccentric phenomenon of the moving rail 23 while only the fixed spring 332 is stretched, a distance from the latching projection 322 to the fixed spring 332 may be appropriately adjusted. Meanwhile, in a state in which the latching projection 322 is fitted into the inclined groove 341, the hooker 34 and the slider 32 are moved forward together. In this state, the latching projection 322 is located in a lower end of the receiving hole 321.

Referring to FIG. 10, when the latching projection 322 is located at the entrance of the latched hole 318, a lower surface 341*a* of the inclined groove 341 presses against the latching projection 322. As such an upward force is applied to the latching projection 322 and the latching projection 322 latches into the latched hole 318. When the door 12 is further withdrawn in this state, the latching projection 322 is separated from the inclined groove 341, and the hooker 34 is moved forward together with the moving rail 23.

When the door 12 backtracks in order to close the storage compartment 15, the hooker 34 is moved in a direction closer to the latching projection 322, and the latching projection 322 is located at the entrance of the inclined groove 341 through the opening 342 as shown in FIG. 10. When the door 12 backtracks further in this state, an upper surface 341*b* of the inclined groove 341 presses the latching projection 322 downward, and thereby the latching projection 322 descends to a starting point of the slide hole 317. The latching projection 322 is also inserted into the inclined groove 341. The latching projection 322 is rapidly moved along the slide hole 317 by the restoring force of the elastic member 33, i.e., the moving spring 331 and the fixed spring 332. Even when a user releases the door 12, the door 12 moves to completely close with the front surface of the cabinet 11.

By this structure, when the door 12 is opened, only the force of a single spring is exerted, and thereby the door 12 may be opened with less force. Further, when the door 12 is closed, the forces of two springs are simultaneously exerted, and thereby a door closing force is maintained.

As disclosed above, a refrigerator 10 includes a cabinet 11 in which a storage compartment is provided. A door 12 selectively opens and closes the storage compartment, and a pair of door frames 121 extends from a rear surface of the door. A first rail assembly 20 is provided at a first side surface (e.g., left surface) of the storage compartment, and a second rail assembly 20' is provided at a second side surface (e.g., right surface) of the storage compartment, where the first and second side surfaces face each other.

At least one of the first rail assembly or the second rail assembly includes a fixed rail 21, a movable rail 23 and an auto closure module 30. The fixed rail is mounted to one of first and second side surface, and the movable rail is configured to slide along a lateral direction of the fixed rail and coupled to the door frame.

An auto closure module is provided at the rear of the fixed rail, and the auto closure module includes a first elastic spring and a second elastic spring having different lengths. The first elastic spring is configured to move with the movable rail such that a restorative force is not exerted for a prescribed distance as the door is pulled, and the second elastic spring has a first end, which is configured to move with the movable rail, and a second end, which is fixed, and such that the second elastic spring is extended to exert a restorative force as the door is pulled.

The first and second elastic springs may be coil springs 331 and 332 having different coefficients of elasticity. The prescribed distance corresponds to a distance needed to un-compress a magnetic gasket provided between the door and the cabinet.

The auto closure module further comprises a guide plate 31, a slide plate 32, a movable latch 34 and a pin shaft 322. The guide plate is fixed to the fixed rail, and includes a horizontal slot 317 and a vertical slot 318 in communication with the horizontal slot. The slide plate has an oval opening 321 and is movable along the horizontal slot of the guide plate. A first end of the first elastic spring is attached to an upper end of the slide plate, and the first end of the second elastic spring is attached to a lower end of the slide plate. The movable latch has an inclined groove 341, and the pin shaft inserted into the horizontal slot, the oval opening and the inclined groove, where the pin shaft is movable with the movable rail.

The movable latch is provided at one of (1) between the guide plate and the slide plate in one embodiment and (2) between the slide plate and the movable rail in a different embodiment. The upper end of the slide plate includes a first latch groove 324 to secure the first end of the first elastic spring, and the lower end of the slide plate includes a second latch groove 323 to secure the second end of the second elastic spring. The first latch groove is offset from the second latch groove in the lateral direction such that the first latch groove is further from the door than the second latch groove.

A second end of the first elastic spring is secured to a mini-slide plate 333 movable along the fixed rail for the prescribed distance and the second end of the second elastic spring is secured to a rear of the guide plate using another latch groove 313. The fixed rail further includes a stop 211 to interfere with a movement of the mini-slide plate when the first elastic spring has moved at least the prescribed distance. The guide plate 31 is attached near the rear of fixed rail. The guide plate has first and second jams 315 and 316 provided at the front and rear of the guide plate, the jams 315 and 315 being provided by different heights at the front and rear of the guide plate 31.

The rail assembly in which the auto closing unit according to an embodiment of the present disclosure that has the above-described configuration is provided and the refrigerator including the rail assembly may have the following effects.

First, the end of any one of the pair of springs mounted in the auto closing unit is provided as a free end, so that the elastic force of the spring having the free end is not exerted at the moment of opening the door. As a result, the door opening force is reduced, whereby the usability is increased.

Second, after the gasket of the door is separated from the main body of the refrigerator, the pair of springs are stretched so that the restoring force is stored, and therefore a force for auto closing is maintained as is, without being reduced.

Third, the length of the spring having the free end is relatively shorter, but its elastic coefficient is made larger so that the restoring force stored in each of the pair of springs is equally exerted, and therefore it is possible to prevent a phenomenon that the moving rail is eccentric in one direction.

In one embodiment, a rail assembly that includes an auto closing unit, comprises: a fixed rail; a moving rail that is movably connected to a side surface of the fixed rail; a guide main body that is fixed to the side surface of the fixed rail, and in which a slide hole is formed in a longitudinal direction thereof; a slider that is movably placed on the guide main body; a latching projection of which one end passes through the slider to be inserted into the slide hole, and of which the other end protrudes from the slider; an elastic member that is connected to the slider and stretched and contracted when the slider is moved; and a hooker that is mounted on the moving rail, in which a guide groove into which the other end of the latching projection is inserted is formed, and that is moved together with the slider in a state in which the other end of the latching projection is inserted into the guide groove. Here, the elastic member may include a fixed spring that is placed on one side of the slider, of which one end is fixed to the guide main body, and of which the other end is fixed to the slider, and a moving spring that is arranged in parallel with the fixed spring on the other side of the slider, of which one end forms a free end separated from the guide main body, and of which the other end is fixed to the slider. Also, a stopper for restraining the movement of the free end of the moving spring may be formed at an edge of the fixed rail in which the moving spring is placed.

In another embodiment, a refrigerator comprises: the rail assembly that includes the auto closing unit, wherein a door is movable in forward/rearward directions by the rail assembly.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet in which a storage compartment is provided;

a door that selectively opens and closes the storage compartment;

a door frame that extends from a rear surface of the door; and a first rail assembly provided at a first side surface of the storage compartment, and a second rail assembly provided at a second side surface of the storage compartment, the first and second side surfaces facing each other, wherein at least one of the first rail assembly or the second rail assembly includes:

a fixed rail mounted to one of first and second side surface, and a movable rail configured to slide along a lateral direction of the fixed rail and coupled to the door frame; and an auto closure module provided at the rear of the fixed rail, the auto closure module having a first elastic spring and a second elastic spring, the first and second springs being different lengths, wherein the first elastic spring is configured to move with the movable rail such that a restorative force is not exerted for a prescribed distance as the door is pulled, and the second elastic spring has a first end, which is configured to move with the movable rail, and a second end, which is fixed, and such that the second elastic spring is extended to exert a restorative force as the door is pulled.

2. The refrigerator of claim 1, wherein the first and second elastic springs are coil springs having different coefficients of elasticity.

3. The refrigerator of claim 1, wherein the prescribed distance corresponds to a distance needed to un-compress a magnetic gasket provided between the door and the cabinet.

4. The refrigerator of claim 1, wherein the auto closure module further comprises:

a guide plate fixed to the fixed rail having a horizontal slot and a vertical slot in communication with the horizontal slot;

a slide plate having an oval opening and movable along the horizontal slot of the guide plate, a first end of the first elastic spring being attached to an upper end of the slide plate, ad the first end of the second elastic spring being attached to a lower end of the slide plate;

a movable latch having an inclined groove; and a pin shaft inserted into the horizontal slot, the oval opening and the inclined groove, the pin shaft being movable with the movable rail.

5. The refrigerator of claim 4, wherein the movable latch is provided at one of (1) between the guide plate and the slide plate and (2) between the slide plate and the movable rail.

6. The refrigerator of claim 4, wherein the upper end of the slide plate includes a first latch groove to secure the first end of the first elastic spring, and the lower end of the slide plate includes a second latch groove to secure the second end of the second elastic spring, the first latch groove is offset from the second latch groove in the lateral direction such that the first latch groove is further from the door than the second latch groove.

7. The refrigerator of claim 4, wherein a second end of the first elastic spring is secured to a mini-slide plate movable along the fixed rail for the prescribed distance and the second end of the second elastic spring is secured to a rear of the guide plate.

8. The refrigerator of claim 7, wherein the fixed rail further includes a stop to interfere with a movement of the mini-slide plate when the first elastic spring has moved at least the prescribed distance.

9. The refrigerator of claim 4, wherein the guide plate includes a first jam and a second jam, the horizontal and vertical slots being provided between the first and second jams, which limit the movement of the slide plate in rearward and forward directions, respectively.

* * * * *